US005542768A

United States Patent [19]

Rother et al.

[11] Patent Number: 5,542,768

[45] Date of Patent: Aug. 6, 1996

[54] APPARATUS FOR PRINTING ON PLASTIC DISK

[75] Inventors: David J. Rother, Hastings; John S. Lee, Coon Rapids; Terence J. Schmidt, St. Paul; Donald Hollerich, Edina; Robert L. Skubic, Chanhassen; Eric Laveen, Eagan, all of Minn.

[73] Assignee: Rimage Corporation, Minneapolis, Minn.

[21] Appl. No.: 382,922

[22] Filed: Feb. 3, 1995

[51] Int. Cl.[6] ..... B41J 25/312

[52] U.S. Cl. ..... 400/120.16; 400/59; 400/279; 400/120.17; 101/41

[58] Field of Search ..... 400/27, 28, 59, 400/58, 120.16, 525, 531, 536, 708, 55, 56, 57, 120.17, 355, 279; 101/35, 41

[56] References Cited

U.S. PATENT DOCUMENTS

| | | | |
|---|---|---|---|
| 3,530,792 | 9/1970 | Valiela . | |
| 4,121,520 | 10/1978 | Shenoha . | |
| 4,248,146 | 2/1981 | Miyasaka et al. . | |
| 4,285,275 | 8/1981 | Sato . | |
| 4,622,897 | 11/1986 | Laverick et al. . | |
| 4,998,471 | 3/1991 | Harrington . | |
| 5,017,028 | 5/1991 | Harding . | |
| 5,237,924 | 8/1993 | Fujino et al. . | |
| 5,239,926 | 8/1993 | Nubson et al. . | |
| 5,281,038 | 6/1994 | Schofield et al. | 400/235 |
| 5,316,395 | 5/1994 | Imai | 400/58 |
| 5,326,179 | 7/1994 | Fuakai et al. | 400/525 |
| 5,423,619 | 6/1995 | Kohno | 400/525 |
| 5,427,029 | 6/1995 | Dumke | 101/484 |

*Primary Examiner*—John S. Hilten
*Attorney, Agent, or Firm*—Palmatier, Sjoquist & Helget, P.A.

[57] ABSTRACT

A printer for printing graphic and alphanumeric information on plastic disks utilizing a printhead having a line array of print pixels. The printhead is pivotally mounted and has an adjustable force mechanism to urge the line array of print pixels into contact with a plastic disk; the plastic disk is mounted on a movable carriage which linearly passes beneath the printhead and the adjustable force mechanism exerts a variable force which is a function of the position of the disk beneath the printhead.

36 Claims, 6 Drawing Sheets

$$l' = 4.72 \sin\left(\arccos\frac{2.36-d'}{2.36}\right) \quad 0<d'<4.72$$

APPARATUS FOR PRINTING ON PLASTIC DISK

BACKGROUND OF THE INVENTION

The present invention relates to an apparatus for printing graphic and alphanumeric information on a printing media; more particularly, the invention relates to an apparatus for printing on plastic disks adapted for holding prerecorded information which has been embedded in the disk by a recording process which is outside the scope of the present invention. Disks of the general type related to this invention are commonly referred to as "compact" disks, or "CD's." These disks are frequently utilized for recording high quality audio and video information and also for recording computer software of various types. The disks are characterized by a construction which is formed of a plurality of layers, including a reflective inner layer, and a relatively smooth top surface, which usually contains printed characters and graphic information describing the disk, the disk content, and the manufacturer. The method and apparatus for printing information on the top surface of the disk must be carefully controlled, for the reasons which are described in more detail herein.

Compact disks are standardized in two sizes and configurations, one having an overall diameter of 4.72 inches, a central hole of 0.59 inches, and a central region about the center hole of 1.50 inches in diameter, wherein no information is either printed or recorded. The other standard disk size is 3.5 inches in overall diameter, with a comparable central hole size and central region. In the case of disks for utilization in connection with computer processors, the recording formats and content are typically adapted to the particular generalized type of computer processor with which the disk is to operate. Some compact disks are recorded in such a way as to be usable with several different computer processor types; i.e., PC, Macintosh, etc. The particular recording formats and conventions are not relevant to the present invention; the present invention is concerned merely with the printing process for assuring a high quality permanent image imprinted on the top surface of the compact disk.

The printing process for printing information and graphics on the surface of plastic disks, particularly compact disks, has typically involved a silk screening printing process or a printer utilizing ink jet printing technology. It is frequently necessary to prepare the disk with a special surface coating in order to cause the printed material to adhere to the disk. These processes are useful in a controlled industrial situation wherein disks are produced in quantity and wherein a large number of disks will necessarily have the same recorded information stored within the disk and, therefore, will require the same information content to be imprinted on the disk surface.

There is another type of compact disk which has become available and which is known by the designation "CDR" which refers to a recordable compact disk. This type of disk is initially prepared in blank, unrecorded form and may be subsequently recorded with unique or custom data at a work site which is remote from the industrial plant where the disk was manufactured. There is a need for a printer which can be used for imprinting identifiable data relating to such disks for which only a relatively few number of copies may be prepared. This silk screening process is not readily adaptable for this type of application, and the ink jet printing technology is not readily applicable unless the printable surfaces are precoated with a layer which will accept the ink jet printed material. However, a thermal printing process could be adapted to this application if a suitable printer were devised for thermal printing.

Thermal printing processes may be generally subdivided into direct thermal transfer devices and indirect thermal transfer devices. A direct thermal transfer device is a printer which utilizes a line array of individually and selectively heatable pixels which may be applied directly against a treated surface so as to directly create an image on the surface from the heated pixels. The surface must be coated with a material which is optically responsive to heat so that the heated pixels will create a permanent image. An indirect thermal transfer device is a printer utilizing a line array of individually and selectively heatable pixels which may be applied against an intermediate medium to cause the intermediate medium to apply the image to the surface. The intermediate medium is typically a heat-sensitive ink ribbon which is positioned intermediate the thermal transfer pixel line array and the CD surface. This process is uniquely adaptable for printing on a CDR, providing that the printing force per unit area; i.e., the force per pixel, is kept at a constant level for all pixels across the line array which contact the CD surface.

In the context of the present invention, both the indirect thermal transfer printer and the direct thermal transfer printer are individually and collectively referred to under the designation "thermal printer"; and it is understood that the terminology "thermal printer" includes either or both types of printing technology. The print pixel line array typically consists of over 1,500 individual pixels arranged linearly along about a five-inch printing line. The pixels are individually heated, and all or a portion of the line array is applied against the surface of either a CD or an inking ribbon which passes between the line array and the CD. The application of a force against the line array and heat applied to the selected pixels causes a print impression onto the CD.

It is desirable that the pressure against the compact disk be uniformly applied during the printing process in order to insure the highest quality of printing onto the compact disk. However, it is difficult to apply uniform printing pressure along a line array of printing pixels when there is relative movement between the compact disk and the printhead, because the length of the compact disk segment beneath the printhead will vary as the relative movement progresses. Initially, only a tangential edge of the disk is positioned beneath the printhead, and the length of the printing segment increases as the disk continues to move relative to the printhead until the maximum disk diameter passes the printhead. Thereafter, the length of the printing segment decreases as the relative movement of the disk continues until finally the trailing tangential edge of the disk passes the printhead. It is apparent that the amount of force applied to the line print array must vary with the length of printing segment beneath the printhead at any given moment, in order to achieve uniform printing pressure over all printing segments.

SUMMARY OF THE INVENTION

A printer for printing graphic and alphanumeric information on plastic disks, particularly utilizing a printhead having a line array of thermal print pixels, wherein the printhead is pivotally mounted on a pivot arm having an adjustable force mechanism to urge the line array of print pixels into contact with a plastic disk. The plastic disk is mounted on a movable carriage which linearly passes beneath the printhead during the printing process, and the adjustable force mechanism exerts a downward force against the printhead which is a function of the disk position beneath the printhead. A print ribbon may be movably positionable between the printhead and the disk.

It is a principal object of the invention to provide a printer for uniformly applying graphical and alphanumeric printed information to a plastic disk.

It is another object of the invention to provide a line array printer which applies constant printing force per print pixel against a disk regardless of the length of the line array applied against the disk.

It is another object of the invention to provide a line array printer which prints information on a disk while moving the disk at a uniform rate relative to the printer.

An advantage of the present invention is that the printing force is controlled to uniformly print along a line of variable length so as to provide a uniform printed image over an area which encompasses print lines of different widths.

The foregoing and other objects and advantages will become apparent from the specification and claims and with reference to the appended drawings.

DESCRIPTION OF THE PREFERRED EMBODIMENT

Figure 1:
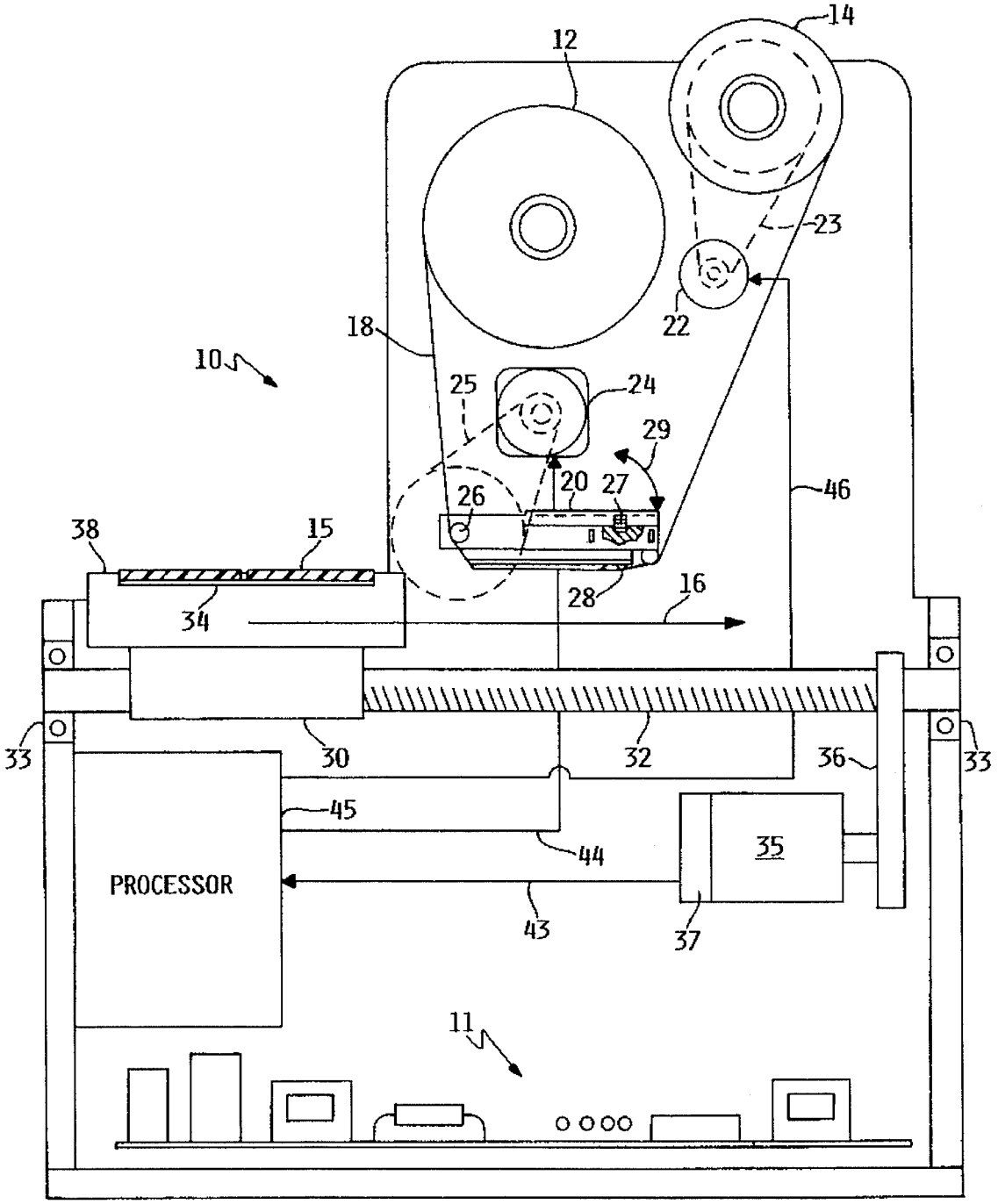
FIG. 1 shows an elevation view of one embodiment of the printer of the present invention.

Referring first to FIG. 1, one embodiment of a printer 10 of the present invention is shown in simplified elevation view, with certain components removed for clarity. A print ribbon 18 is supplied from a ribbon supply reel 12, and passes beneath a printhead 20 to a take-up reel 14. The ribbon take-up reel 14 is driven by a ribbon motor 22 via a belt 23 which connects motor 22 to reel 14. The printhead 20 is pivotally mounted on a pivot shaft 26. Pivot shaft 26 is mechanically connected to a printhead motor 24 via a belt 25. Activation of printhead motor 24 causes printhead 20 to pivot about pivot shaft 26 in either direction indicated by arrow 29. A print pixel line array 28 is mounted to the undersurface of printhead 20 and is pivotally attached to printhead 20 by print pixel pivot 27.

A carriage 30 is mounted to a screw drive mechanism beneath printhead 20. Carriage 30 is threadably attached to a rotatable screw 32 and screw 32 is driven by a carriage drive motor 35, which is connected to screw 32 by belt 36. Screw 32 is mounted between bearings 33 and is freely rotatable by the drive connection to carriage drive motor 35. A disk holder 38 is attached on carriage 30 and is movable in the direction of arrow 16 by drive motor 35. A disk 15 may be mounted on disk holder 38 and is carried on a resilient pad 34 in a recess in disk holder 38.

An encoder 37 is connected to drive motor 35 for monitoring the turns of rotation of drive motor 35, thereby to detect the relative position of carriage 30 along screw 32. Encoder 37 is connected via a line 43 to a processor 45 to transmit electrical position information to processor 45 which is representative of the position of carriage 30 along screw 32. Processor 45 may be any commercially-available computer processor, which is properly programmed to receive the signals described herein and to transmit the drive signals to be hereinafter described. Processor 45 calculates a drive signal for activating printhead motor 24 and transmits this signal to printhead motor 24 via line 44. Processor 45 also utilizes the position signals received from encoder 37 to calculate a drive signal for activating ribbon drive motor 22. This drive signal is transmitted via line 46 to ribbon drive motor 22 so as to drive the ribbon take-up reel 14 at a rotational rate which moves ribbon 18 in coincidence with the movement of carriage 30.

Figure 2A:
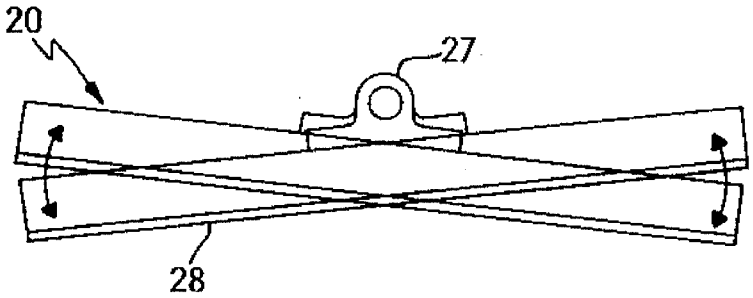
FIG. 2A shows a diagrammatic view of the printhead.

FIG. 2A shows a view of the printhead 20 primarily illustrating the pivotal motion of the print pixel line array 28. The print pixel line array 28 is a part of the printhead 20 and is connected to a pivot arm 82 by a pivot mounting 27. Pivot mounting 27 permits a limited range of pivotal motion of the print pixel line array 28, as illustrated by the arrows in FIG. 2A, to permit the line array 28 to align itself against a disk.

Figure 2B:
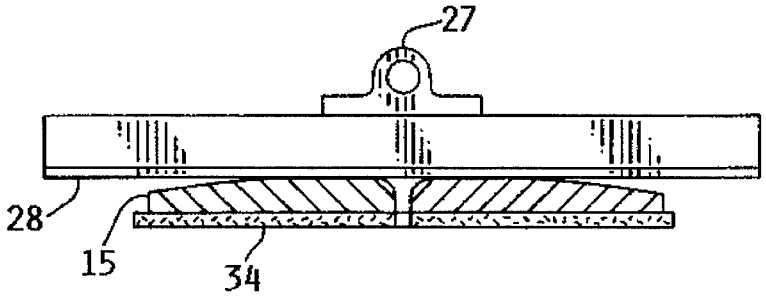
FIG. 2B shows the printhead over a disk with no force applied to the printhead.

FIG. 2B shows a view of the print pixel line array 28 positioned over a disk 15 with no force applied to the printhead 20. Disk 15 rests on a resilient pad 34, and the view of disk 15 is exaggerated to show that the top surface of disk 15 is somewhat irregular and is not a perfectly flat surface. Therefore, there is not a perfectly uniform line contact match between print pixel array 28 and disk 15 in the usual situation.

Figure 2C:
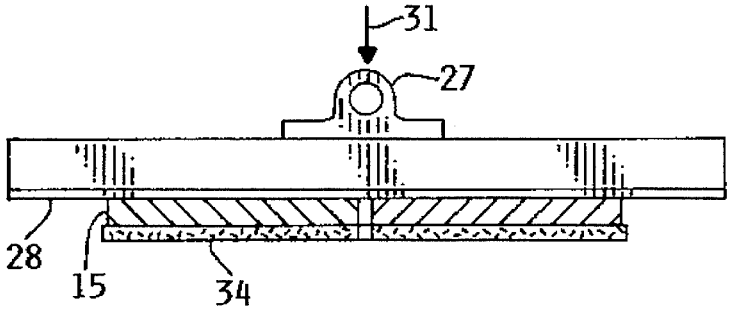
FIG. 2C shows the printhead over a disk with force applied to the printhead.

FIG. 2C shows a view of the print pixel line array 28 positioned over a disk 15 with downward force applied to the printhead 20, as exemplified by the arrow 31. In this situation, the print pixel line array 28 is forced downwardly against the top surface of disk 15 sufficiently hard to slightly deform the disk to form a uniform line contact between the print pixel line array 28 and the disk 15. The resilient pad 34 permits this deformation to occur, and the pad 34 becomes slightly compressed where necessary to permit the uniform line contact to be made.

Figure 3A:
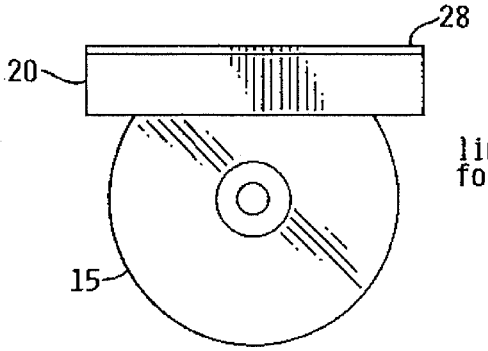
FIGS. 3A, 3B, 3C and 3D show top views of the printhead and disk in several different printing positions.
Figure 3B:
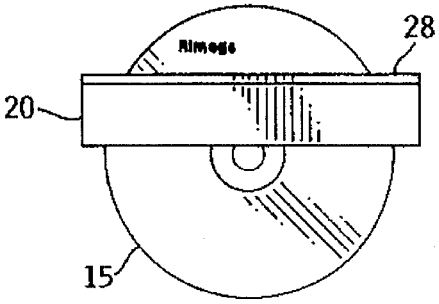
Figure 3C:
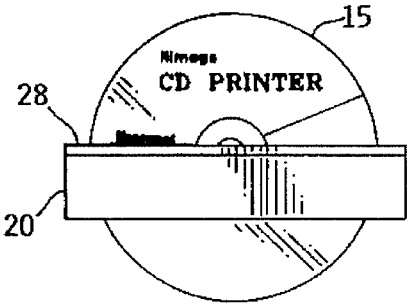
Figure 3D:
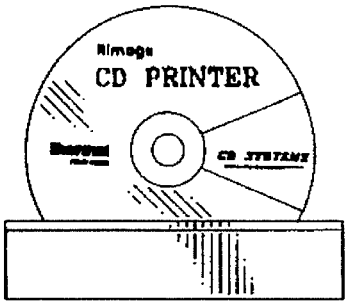

FIGS. 3A–3D show top views of the relative positions of printhead 20 and a disk 15 during a printing process. Specifically, FIG. 3A shows the disk 15 at the beginning point of its traverse beneath line array 28 at a position just prior to the alignment of print pixel line array 28 over the edge of disk 15. FIG. 3B shows the disk 15 in a position approximately ¼ of the distance of traverse of the disk beneath the line array 28; at this position, a representative printing of the word "Rimage" has already occurred on the disk 15. FIG. 3C shows the disk 15 in a position approximately ½ of the distance of traverse of the disk 15 beneath the line array 28, wherein the printing on the top surface of disk 15 is approximately ½ completed. FIG. 3D shows the disk 15 in a position approximately ¾ of the distance of traverse of the disk beneath the line array 28, wherein a further portion of the printing on the top surface of disk 15 has been completed. It is apparent from FIGS. 3A–3D that the length of print pixel line array 28 which directly contacts disk 15 varies as the relative position of disk 15 varies.

Figure 4A:
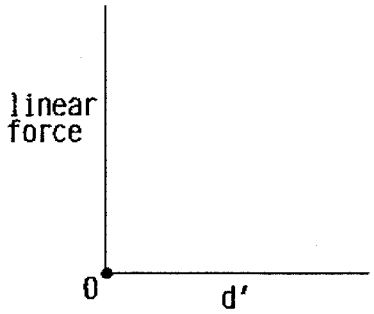
FIGS. 4A, 4B, 4C, and 4D show force curves illustrating the printhead force corresponding to each of the positions of FIGS. 3A–3D.
Figure 4B:
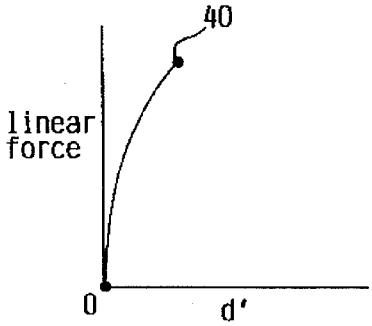
Figure 4C:
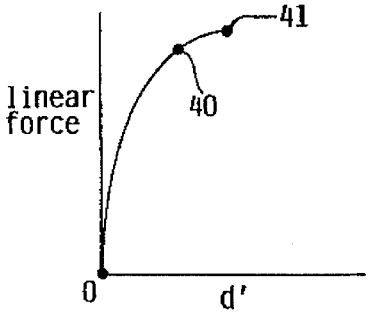
Figure 4D:
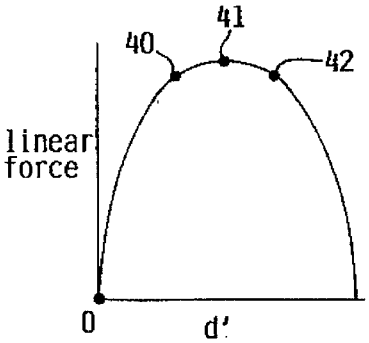

FIGS. 4A–4D show diagrams illustrating the linear force applied against printhead 20 for each of the positions shown in FIGS. 3A–3D, and FIG. 4D also illustrates the force curve for all positions of disk 15 relative to printhead 20. FIG. 4A shows no force applied to printhead 20 at the relative position shown in FIG. 3A. FIG. 4B shows a force illustrated by the point 40, which occurs at the position shown in FIG. 3B; FIG. 4B also shows the force curve as the relative positions changed from that shown in FIG. 3A to that shown in FIG. 3B. FIG. 4C shows a force illustrated by the point 41, which occurs at the position shown in FIG. 3C and also shows the force curve as the relative positions changed from that shown in FIGS. 3A, 3B and 3C. FIG. 4D shows a force illustrated by the point 42, which occurs at the position shown in FIG. 3D, and also shows the force curve as the relative positions changed from that shown in FIGS. 3A–3D. FIG. 4D also shows, in dotted outline, the total force curve as the disk 15 traverses the entire distance beneath the printhead 20. In each of the FIGS. 4A–4D the horizontal axis of the diagram is a measure of the distance d' by which the disk 15 has traversed the printhead, and the vertical axis is a measure of the force applied to the printhead, as illustrated by the arrow 31 of FIG. 2C.

Figure 5:
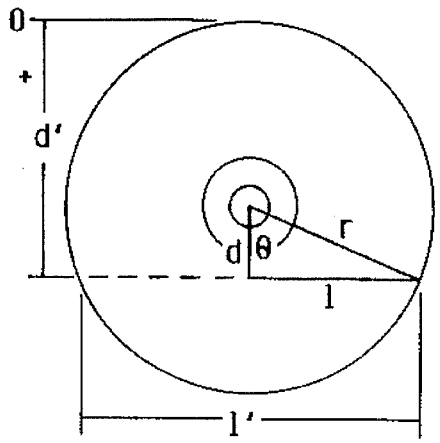
FIG. 5 shows a diagram of the force/position relationship and the equation relating force to disk position.

FIG. 5 shows a diagram illustrating the relative distances of traverse of disk 15, relative to printhead 20, and the calculation of the force to be applied against the printhead 20 as a function of these relative distances. For example, the distance d' is measured from an edge of disk 15 to the line of contact of print pixel line array 28; the distance l' is the length of print pixel line array 28 which actually contacts disk 15 at the position distance d'. The value r is the radius of disk 15. The amount of downward force applied against printhead 20 is directly proportional to the distance l', which is the length of the print pixel line array contacting the disk 15 at any relative position. This can be expressed by the equation:

$$F = 2rk \sin\left(\arccos \frac{r - d'}{r}\right)$$

where F is the force applied to printhead 20; k is a constant; and d' is less than twice the radius (2*r*). FIG. 5 shows this equation in relationship to the diagram and under the assumption that the disk 15 radius is 2.34 inches.

In operation, the force to be applied to the printhead 20 is applied by the printhead motor 24, which preferably is a stepper motor having incremental rotational positions. As the motor is driven in one rotational direction or the other, the printhead is forced to pivot about pivot shaft 26, thereby forcing print pixel line array 28 upwardly or downwardly. The distance measurement required in the force equation is made by measuring the position of carriage 30 along screw 32. This measurement may be conveniently made if carriage drive motor is a stepper motor which may be incrementally driven, for then the distance measurement may be made by merely counting the driving pulses applied to the motor 35. It is apparent that the necessary electrical measurements and the calculations associated therewith can be accomplished by a properly programmed computer processor well within the state of the existing art of computer and electronic technology.

It is desirable that the ink ribbon 18 be moved across the printhead 20 at the same relative rate as the carriage 30, and it is apparent that this can readily be accomplished if the ribbon drive motor 22 is also a stepper motor which can be incrementally driven to achieve the same linear drive rate for ribbon 18 as for carriage 30. The electronics required for operation of the invention described herein may all be housed in the same cabinet with printer 10, as for example, at location 11 shown in FIG.1.

Figure 7:
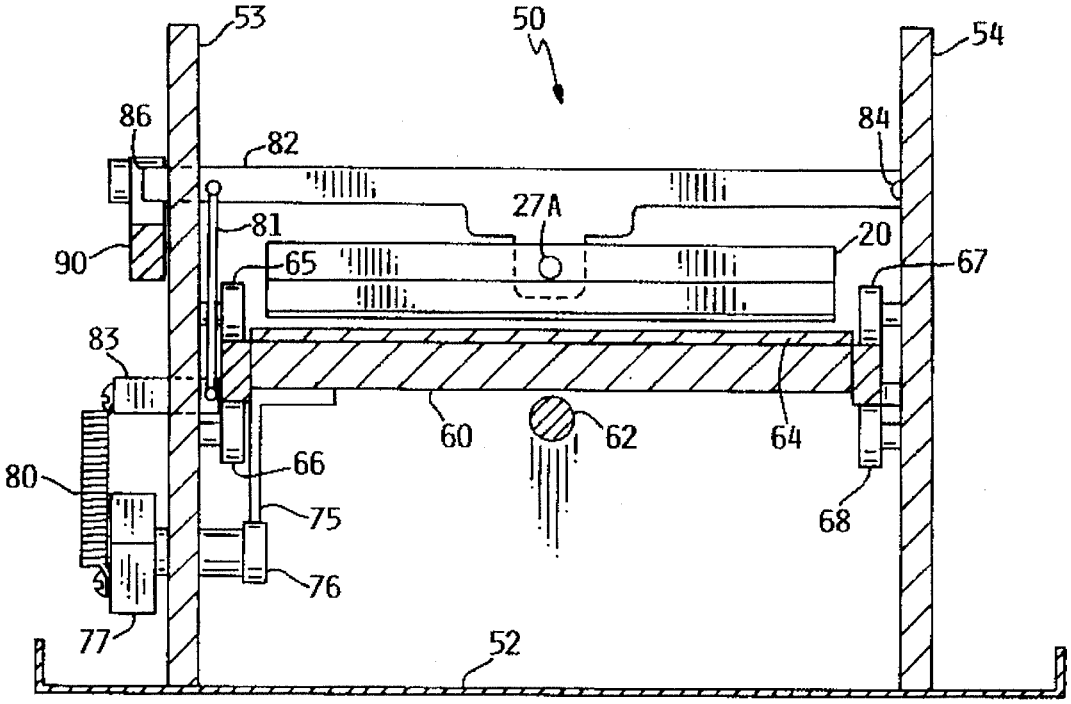
FIG. 7 shows a cross-section view taken along the lines 7—7 of FIG. 6.
Figure 6:
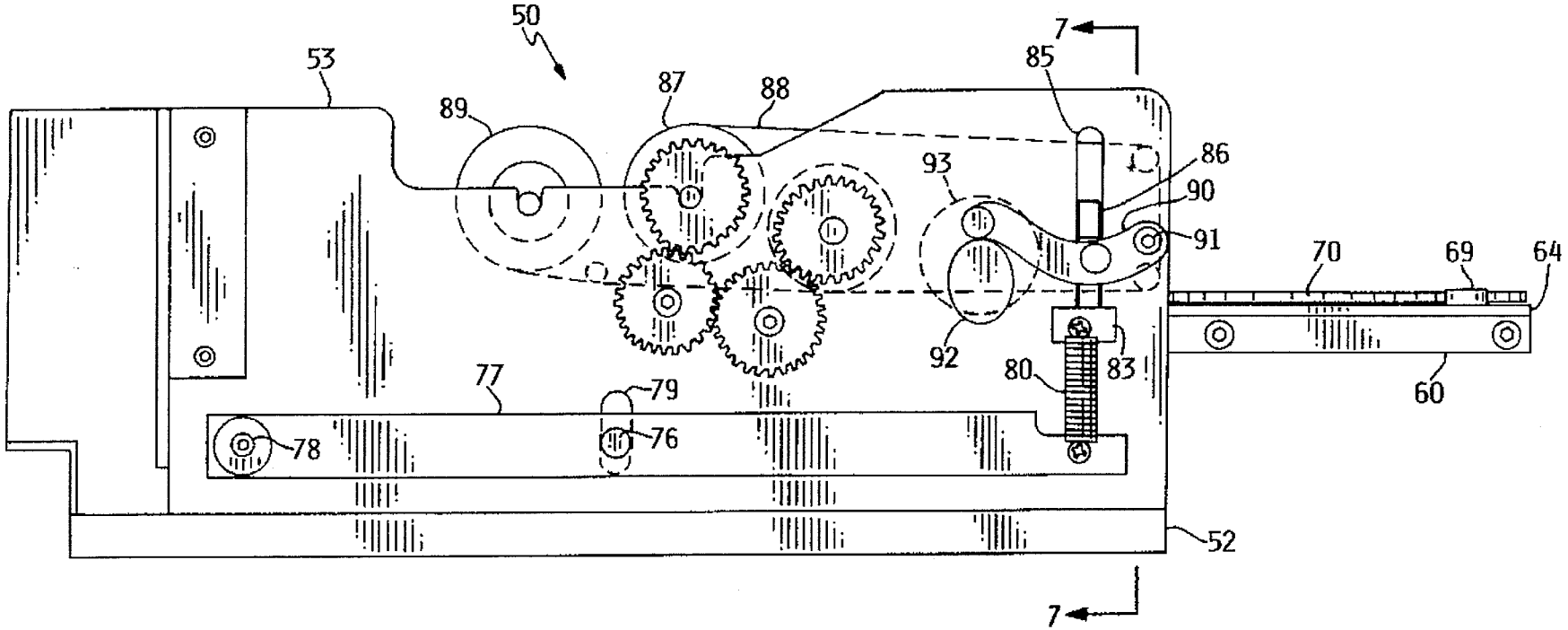
FIG. 6 shows an elevation view of a preferred embodiment of the present invention.
Figure 8:
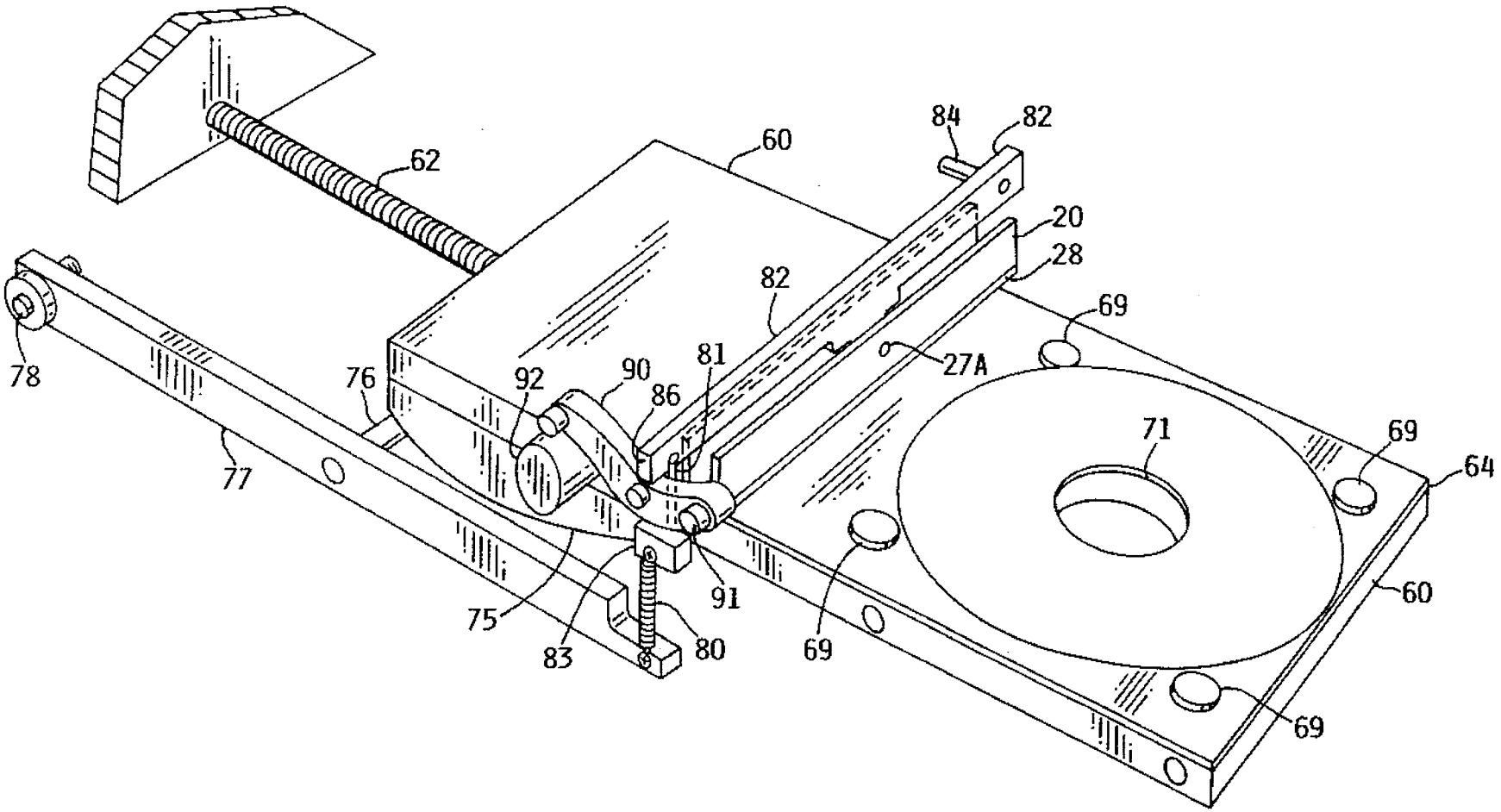
FIG. 8 shows a partial isometric view of components of the invention.

FIG. 6 shows an elevation view of a preferred embodiment of the present invention. FIG. 7 shows a cross-section view taken along the lines 7—7 of FIG. 6 and FIG. 8 shows a isometric view of certain components of the invention of FIG. 6. A printer 50 is mounted to a base 52, which can form a part of a cabinet for housing printer 50. A carriage 60 is slidably movable into and out of printer 50 by means of a drive screw 62 which is connected to a motor (not shown). Carriage 60 is guided between sets of rollers 65, 66 and 67, 68, respectively positioned on the side walls 53, 54 of printer 50. Carriage 60 holds a top plate 64 and a set of positioning lugs 69 which are located so as to properly position a compact disk 70 on carriage 60. A resilient pad 71 is set onto a top plate 64, and sized to have the approximate same outer diameter as a compact disk 70. FIG. 6 shows a compact disk 70 positioned properly on carriage 60, whereas FIG. 8 shows the resilient pad 71 positioned on carriage 60, and does not show a compact disk in place.

An arcuate cam lobe 75 is affixed to the underside of carriage 60, and projects downwardly from carriage 60. Cam lobe 75 moves with carriage 60 and is engageable against a roller 76 which is affixed to a pivot bar 77. Pivot bar 77 is pivotally attached to side wall 53 by a fastener 78, and roller 76 is connected to pivot bar 77 via a slot 79 in side wall 53. In operation, the inward movement of carriage 60 causes cam lobe 75 to engage against roller 76, thereby forcing pivot bar 77 to pivot downwardly about fastener 78, and against the spring force of spring 80.

Spring 80 is an extension spring having one end connected to pivot bar 77 and the other end connected to a printhead pivot arm 82. One end of printhead pivot arm 82 is pivotally supported about a pivot pin 84, and the other end is connected to spring 80 via a link 81 connected to a bracket 83, which produces a net downward force urging the pivot arm 82 to pivot downwardly about pivot pin 84. The support bracket end 83 projects through a slot 85 in side wall 53. A printhead 20 is pivotally mounted to pivot arm 82 via a pivot pin 27A. The downward pivotal movement of pivot arm 82, and printhead 20, is ultimately limited by the contact of printhead 20 against a compact disk 70 which rests upon resilient pad 71.

Pivot arm 82 has an end 86 projecting through slot 85 in side wall 53. End 86 is engageable by a cam lever 90 which is pivotally affixed at pin 91 to side wall 53. Cam lever 90 is pivotally movable by a cam 92 which is driven by a motor 93. When motor 93 is actuated to cause cam 92 to rotate to the position shown in FIG. 6, cam 92 engages against cam lever 90 to force it upwardly about pivot point 91, thereby lifting the end 86 upwardly, and causing pivot arm 82 to pivot upwardly about pivot pin 84. This motion effectively lifts the printhead upwardly and away from contact against carriage 60. In operation, motor 93 is actuated to rotate cam 92 so as to cause printhead 20 to raise upwardly when carriage 60 is in the extended or retracted position from printer 50. Motor 93 is then actuated to lower printhead 20 toward the compact disk placed upon carriage 60, while the compact disk and carriage 60 are simultaneously drawn into the printer 50 by action of screw 62. When line array 28 is in contact against the compact disk resting on carriage 60, the downward force urged on printhead 20 is the net spring force caused by spring 80. This net spring force is increased as carriage 60 is drawn into the printer 50 housing, because arcuate cam lobe 75 presses downwardly against roller 76, thereby causing pivot bar 77 to pivot downwardly to increase the spring force of spring 80.

FIG. 6 also illustrates the relative positioning of an ink ribbon 88 which progresses between an ink payout roller 87 to a take-up roller 89, and is routed along its path via a number of intermediate guide shafts as shown in FIG. 6. The take-up roller 89 is driven by a motor (not shown) to cause ink ribbon 88 to move linearly between printhead 20 and compact disk 70 at a similar rate of travel as compact disk 70. Position sensors (not shown) can be used to sense the relative position of carriage 60; and therefore, compact disk 70, as it progresses into and out of the printer 50 housing. These position sensors can generate the necessary electrical signals to cause actuation of the ink ribbon drive motor and cam motor 93.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. An apparatus for printing information on a surface with uniform printhead pressure, comprising:

a) a printer frame having a movable carriage mounted thereon, said carriage having means for supporting a printing surface, and said carriage being movable over a linear path of travel;

b) a printhead pivotally mounted over said carriage path of travel, said printhead having a line array of print pixels;

c) means for controllably pivoting said printhead, whereby the upward and downward force on said line array of print pixels may be selectively applied;

d) means for moving said carriage over said linear path of travel, including means for detecting the position of said carriage; and e) means for utilizing the position detected by said means for detecting to create a force component based on said detected position, and including means for determining the length of the line array of print pixels which is applied to the printing surface for each position of said carriage, and means for transmitting said force component to said means for controllably pivoting, the downward force applied to said line array of pixels being determined by said carriage position and the length of the line array of print pixels applied to said printing surface.

2. The apparatus of claim 1, further comprising a printer ribbon connected between a supply reel and a take-up reel, said printer ribbon passing between said carriage and said printhead.

3. The apparatus of claim 2, further comprising means for controlling said supply reel and take-up reel.

4. The apparatus of claim 3, wherein said carriage means for supporting a printing surface further comprises a resilient surface.

5. The apparatus of claim 4, wherein said line array of print pixels is pivotally connected to a pivot arm, and said pivot arm is connected to receive said force component.

6. An apparatus for printing information on a compact disk surface with uniform printhead pressure, comprising:

a) a printer frame having a movable carriage mounted thereon, said carriage having means for supporting a printing surface, and said carriage being movable over a linear path of travel;

b) a printhead pivotally mounted over said carriage path of travel, said printhead having a line array of selectively heatable print pixels;

c) means for controllably pivoting said printhead, whereby the upward and downward force on said line array of print pixels may be selectively applied;

d) means for moving said carriage over said linear path of travel, including means for detecting the position of said carriage; and e) means for utilizing the position detected by said means for detecting to create a force component based on said detected position, and based upon the length of said line array of print pixels which is applied to said printing surface at each said detected possition, and means for transmitting said force component to said means for controllably pivoting, the downward force applied to said line array of pixels being determined by said carriage position and the force per unit area of print pixels against said compact disk is constant.

7. The apparatus of claim 6, wherein said compact disk futher comprises a recordable compact disk.

8. The apparatus of claim 6, further comprising a printer ribbon connected between a supply reel and a take-up reel, said printer ribbon passing between said carriage and said printhead.

9. The apparatus of claim 8, further comprising means for controlling said supply reel and take-up reel.

10. The apparatus of claim 6, wherein said carriage means for supporting a printing surface further comprises a resilient surface.

11. The apparatus of claim 10, wherein said line array of print pixels is pivotally connected to a pivot arm, and said pivot arm is connected to receive said force component.

12. A method for printing on circular plastic disks with a line array of thermally activated print pixels, comprising: providing a line array of print pixels;

a) supporting the plastic disk on a resilient support base;

b) moving said support base at a uniform rate of speed along a path of travel which is adjacent said line array of print pixels and normal to the alignment of said line array of print pixels;

c) interposing a printing transfer ribbon between said line array and the plastic disk;

d) applying a force on said line array, against said transfer ribbon and the plastic disk, said force being directly proportional to the length of said line array which contacts said transfer medium and the plastic disk; and wherein said plastic disk is circular and has an overall diameter D, and the instantaneous position of said line array relative to an edge of the plastic disk is d', said force further comprises a force which is determined by the equation:

$$F=DK \sin\{\arccos(1=2d'/D)\}; \text{ where k is a constant; and}$$

e) selectively activating said thermally activated print pixels to transfer printed pixels from said transfer medium to the plastic disk.

13. A printer having a carriage movable over a linear path of travel and a printhead having a line array of selectively heatable print pixels pivotally mounted over said path of travel about an axis parallel to said path of travel, comprising:

a) control means for moving said carriage and for detecting the position of said carriage over said path of travel;

b) a printhead driver connected to said control means, said printhead driver having means for controlling the force of said printhead toward said carriage;

c) means for holding an article for printing on said carriage, the force of said printhead being determined by the position of said carriage over said path of travel: and d) means for calculating the length of said line array of pixels positioned above said article, and for controlling said printhead driver as a result thereof to correspondingly vary the force of said printhead.

14. The apparatus of claim 13, wherein said means for holding an article comprises a resilient surface.

15. The printer of claim 13 further comprising a printer ribbon interposed between said printhead and said carriage.

16. The apparatus of claim 13, wherein said article comprises a plastic disk.

17. The apparatus of claim 14, further comprising a take-up reel connected to said printer ribbon and a ribbon controller connected to said control means, whereby said ribbon is moved at a rate corresponding to movement of said carriage.

18. The apparatus of claim 17, wherein said line array of pixels is mounted as a part of said printhead.

19. A thermal printer having a carriage movable over a linear path of travel and a printhead having a line array of selectively heatable print pixels pivotally mounted over said path of travel about an axis parallel to said path of travel, comprising:

a) control means for moving said carriage along said path of travel;

b) a cam lobe affixed to said carriage; said cam lobe having a surface curvature determined by a calculating the length of said line array of print pixels positioned above said article for each position of said carriage;

c) a pivot bar having a cam follower guided by said cam lobe and having a distal end connected to said printhead, the downward force applied against said printhead by said distal end being variable; and d) means for holding a compact disk for printing on said carriage, the downward force of said printhead being determined by the position of said carriage over said path of travel.

20. The apparatus of claim 19, wherein said article comprises a recordable compact disk.

21. The apparatus of claim 20, wherein said line array of pixels is mounted as a part of said printhead.

22. The apparatus of claim 21, wherein said means for holding a compact disk comprises a resilient surface.

23. A thermal printer comprising:

a) a printer housing containing a carriage movable over a linear path of travel, and a selectively heatable line array of print pixels movably positionable in said housing and adjacent said path of travel;

b) an arcuate cam surface affixed to said carriage and movable therewith;

c) a pivot bar pivotally attached to said housing and having a cam roller positioned to contact said arcuate cam surface, said pivot bar having a movable distal end;

d) a pivot arm pivotally attached to said housing about a pivot pin having an axis aligned with said linear path of travel, said pivot arm having a distal end connected to said pivot bar distal end;

e) said line array of print pixels pivotally mounted to said pivot arm; whereby movement of said carriage along said linear path of travel pivotally moves said pivot bar and said pivot arm thereby causing a downward force on said line array of print pixels which is related to the position of said carriage; and.

f) a second cam engageable against said pivot arm and motor means for actuating said second cam to pivotally raise and lower the distal end of said pivot arm.

24. The apparatus of claim 23, wherein said carriage further comprises a resilient surface for supporting a compact disk.

25. The apparatus of claim 24, wherein the connection between said pivot bar and said printhead bracket further comprises a resilient spring.

26. The apparatus of claim 25, wherein said compact disk further comprises a recordable compact disk.

27. A printer having a carriage movable over a linear path of travel and a printhead movably positionable over said path of travel, comprising:

a) a printer housing for receiving said carriage and for holding said printhead;

b) an arcuate cam surface affixed to said carriage and movable therewith;

c) a pivot bar pivotally attached to said housing and having a cam roller positioned to contact said arcuate cam surface, said pivot bar having a movable distal end;

d) a pivot arm pivotally attached to said housing about a pivot pin having an axis aligned with said linear path of travel, said pivot arm having a distal end connected to said pivot bar distal end;

e) said printhead pivotally mounted to said pivot arm; whereby movement of said carriage along said linear path of travel pivotally moves said pivot bar and said pivot arm, thereby causing a downward force on said printhead which is related to the position of said carriage; and f) a second cam engageable against said pivot arm, and motor means for actuating said second cam to pivotally raise and lower the distal end of said pivot arm.

28. The apparatus of claim 27, wherein the connection between said pivot bar and said pivot arm further comprises a resilient spring.

29. The apparatus of claim 28, wherein said carriage further comprises a resilient surface for holding an article for printing.

30. The apparatus of claim 29, wherein said article further comprises a plastic disk.

31. A method for printing on circular plastic disks with a line array of thermally activated print pixels, comprising: provide a line array of print pixels a) moving the plastic disk at a uniform rate of speed along a path of travel which is adjacent said line array of print pixels;

b) interposing a printing transfer medium between said line array and said plastic disk;

c) applying a force on said line array, against said transfer medium and the plastic disk, said force being directly proportional to the length of said line array which contacts said transfer medium and the plastic disk; and wherein the plastic disk is circular and has an overall diameter D, and the instantaneous position of said line array relative to an edge of said plastic disk is d', said force further comprises a force which is determined by the equation:

$$F=DK \sin\{\arccos(1-2d'/D)\}$$; where k is a constant; and d) selectively activating said thermally activated print pixels to transfer printed pixels from said transfer medium to said plastic disk.

32. The method of claim 31, wherein the step of interposing a transfer medium between said line array and said plastic disk further comprises moving said transfer medium at a uniform rate along a direction parallel to said path of travel.

33. The method of claim 32, wherein said transfer medium further comprises an ink ribbon, and said step of moving said transfer medium further comprises moving said ink ribbon between a supply and take-up reel.

34. The method of claim 31, further comprising the initial step of supporting said plastic disk on a resilient support surface.

35. The method of claim 34, wherein said plastic disk further comprises a compact disk.

36. The method of claim 34, wherein said plastic disk further comprises a recordable compact disk.

* * * * *